United States Patent [19]

Essack

[11] Patent Number: 5,040,721

[45] Date of Patent: Aug. 20, 1991

[54] WEDGE CARTON AND INSERT ASSEMBLY

[75] Inventor: Franklin N. Essack, Charlotte, N.C.

[73] Assignee: Textron Inc., Providence, R.I.

[21] Appl. No.: 514,617

[22] Filed: Apr. 26, 1990

[51] Int. Cl.[5] ..... B65D 85/00

[52] U.S. Cl. ..... 229/112; 229/108.1; 229/117.1; 229/199; 206/588; 206/590

[58] Field of Search ..... 206/590, 589, 588, 594; 229/112, 115, 199, 108.1, 117.1

[56] References Cited

U.S. PATENT DOCUMENTS

| | | | |
|---|---|---|---|
| 1,252,051 | 1/1918 | Stone . | |
| 1,833,974 | 12/1931 | Powell et al. . | |
| 2,812,891 | 4/1954 | Carlson et al. | 229/115 |
| 3,659,772 | 5/1972 | Dorsey et al. | 229/DIG. 4 |
| 3,924,799 | 12/1975 | Lorenz | 229/39 |
| 4,042,165 | 8/1977 | Elder | 229/DIG. 4 |
| 4,230,729 | 10/1980 | Hoelzel | 229/112 |
| 4,828,115 | 5/1989 | Wiegand | 206/590 |
| 4,900,163 | 2/1990 | Mack | 229/199 |

FOREIGN PATENT DOCUMENTS

| | | | |
|---|---|---|---|
| 257137 | 4/1964 | Netherlands | 81/7 |

*Primary Examiner*—Stephen Marcus
*Assistant Examiner*—Christopher McDonald
*Attorney, Agent, or Firm*—Perman & Green

[57] ABSTRACT

A packaging carton and insert assembly for use in packaging an article. The assembly has an outer carton and a stiffening insert. The outer carton is collapsible to form a relatively flat profile and has a non-collapsed wedge shaped profile. The insert has a general wedge shaped profile and when inserted into outer carton, wedges two opposite sides of the carton apart to prevent the carton from collapsing.

13 Claims, 3 Drawing Sheets

WEDGE CARTON AND INSERT ASSEMBLY

BACKGROUND OF THE INVENTION

1. Field of the Invention

The present invention relates to packaging of articles and, more particularly, to a wedge carton and insert assembly.

2. Prior Art

Various different wedge shaped cartons and containers have been used in the past. U.S. Pat. No. 1,252,051 to Stone discloses a carton case for collapsible tubes with sides that yield under pressure and bow or bulge outwardly. U.S. Pat. No. 1,833,974 to Powell et al. discloses a wedge shaped container with collapsible sides of bellows construction and a non-collapsible closure that acts as a brace. U.S. Pat. No. 3,924,799 to Lorenz discloses a collapsible protective tube with crease or fold lines.

For obvious reasons, it is sometimes desirable to package items in wedge shaped containers or cartons such as to more densely pack multiple packages into larger containers or for ease in shipping and storage. Another such situation is for irregular shaped articles such as the pole and engine of a string-trimmer. However, various disadvantages have arisen with prior art wedge shaped containers.

One problem is that it is preferable to provide an empty container that is relatively flat or compact, prior to insertion of an article or goods thereinto, to allow for compact storage of the empty containers and easier shipping of empty containers to a packaging or loading site. However, in the past, this often necessitated shipping of pre-printed and pre-cut container blanks in an unfastened or assembled state and having to do the assembly of the container, hand wrapping and gluing of the blanks, after the goods are placed on the carton at the loading or packaging site. This of course required relatively time consuming manual assembly of the container around the goods.

Another problem is that partially preassembled containers such as disclosed in U.S. Pat. No. 1,833,974 that have crease lines to make the containers flat for storage, do not provide sufficient stiffness to the container after the goods are inserted to prevent partial inadvertent collapse during shipping of the container with its article or when multiple containers are stacked on top of each other.

Another problem is that it is desirable to have printed matter such as graphics on the outside of containers. In the prior art, center seams on a main panel, such as shown in FIG. 4 of U.S. Pat. No. 1,833,974, prevented uninterrupted graphics. In addition, graphics on collapsible panels of a container were often distorted when the container was enlarged because the panels did not always fully straighten or because the panels partially collapsed during shipment which lessened the attractive appearance of the packaging.

It is therefore an objective of the present invention to provide a new and improved wedge carton and insert assembly that overcomes these problems as well as provide other features and advantages.

SUMMARY OF THE INVENTION

The foregoing problems are overcome and other advantages are provided by a collapsible wedge shaped outer carton and a stiffening insert assembly.

In accordance with one embodiment of the present invention a packaging assembly for packaging and transporting an article is provided. The assembly comprises a collapsible outer carton and a stiffening insert. The collapsible outer carton is comprised of a unitary sheet of cardboard with a first rectangular section, a second rectangular section, a first trapezoidal section, a second trapezoidal section, and a joint flap. The first trapezoidal section is located between the first and second rectangular sections and the second trapezoidal section is located between the first and second rectangular sections opposite the first triangular section with first fold lines at junctions between the rectangular and trapezoidal sections. The first and second trapezoidal sections have second fold lines longitudinally therealong and the joint flap is fixed to the first rectangular section such that the outer carton can have at least two configurations; a first configuration with the outer carton bent at the second fold lines such that the outer carton has a substantially flat profile and, a second configuration with the outer carton bent at the first fold lines such that the outer carton has a substantially wedge shaped profile. The stiffening insert has a general wedge shaped profile and is located inside the outer carton and is suitably sized and shaped to substantially prevent the outer carton from collapsing along the second fold lines to thereby retain the outer carton wedge shaped profile during shipment of the assembly and the article packaged therein.

In accordance with another embodiment of the present invention a package assembly for an article is provided comprising a collapsible outer carton and a stiffening insert. The collapsible outer carton has means for forming two shapes, a first relatively flat shape and a second relatively wedge shape. The stiffening insert has a general wedge shape and is suitably sized and shaped and located inside the outer carton to prevent the outer carton from collapsing to its relatively flat shape such that the outer carton is substantially prevented from collapsing after an article and the insert are inserted thereinto and, prior to insertion of the insert, the outer carton can be collapsed to its relatively flat shape for compact storage.

In accordance with one method of the invention, a method of packaging an article is provided comprising the steps of providing an outer carton, the carton having a preglued main seam thereby forming a substantially enclosed channel and further comprising means for forming two profiles, a first relatively flat shaped profile and a second relatively wedge shaped profile, the outer carton being provided in the relatively flat shaped profile; changing the shape of the carton from the relatively flat shaped profile to the relatively wedge shaped profile; inserting an article into the outer carton channel; inserting a stiffening insert into the outer carton channel, the insert having a general wedge shape and being suitably sized and shaped to bear against the inside of the carton and substantially prevent the outer carton from collapsing to its relatively flat shaped profile; and closing end flaps on the outer carton to enclose the article inside the outer carton.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
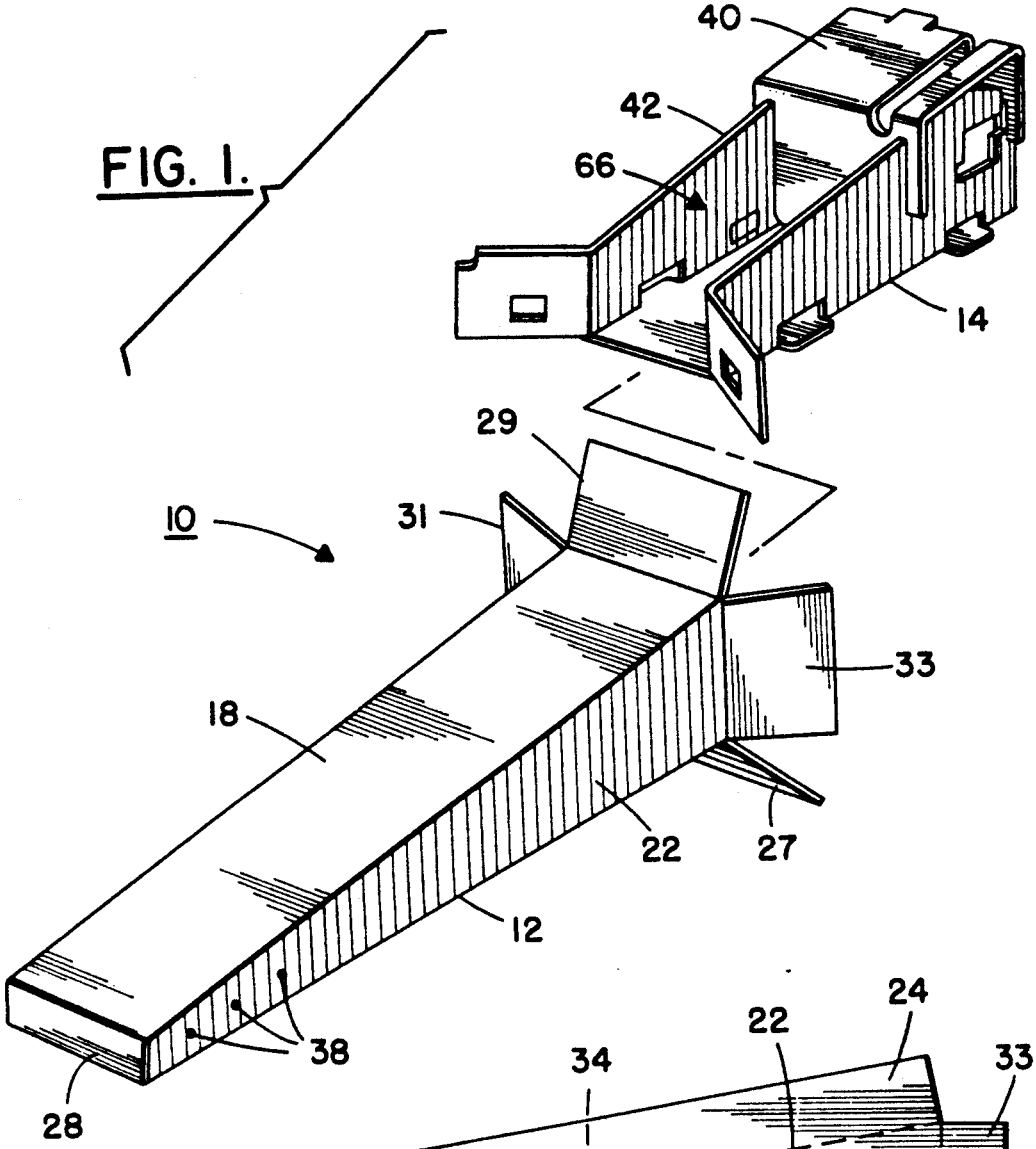
FIG. 1 is an exploded perspective view of a wedge carton and insert assembly incorporating features of the present invention.

Referring to FIG. 1, there is shown an exploded perspective view of a packaging assembly 10 incorporating features of the present invention. Although the present invention is being described with reference to the embodiment shown in the figures, it should be understood that the present invention can be embodied in many alternate embodiments. In addition, any suitable size, shape or type of materials may be used to practice the invention. The assembly 10 shown in FIG. 1 generally comprises an outer carton 12 and a stiffening insert 14. The stiffening insert 14 is generally intended to be received inside an interior chamber formed by the outer carton 12 to add structural support thereto and to at least partially hold articles or goods therewith.

Figure 2:
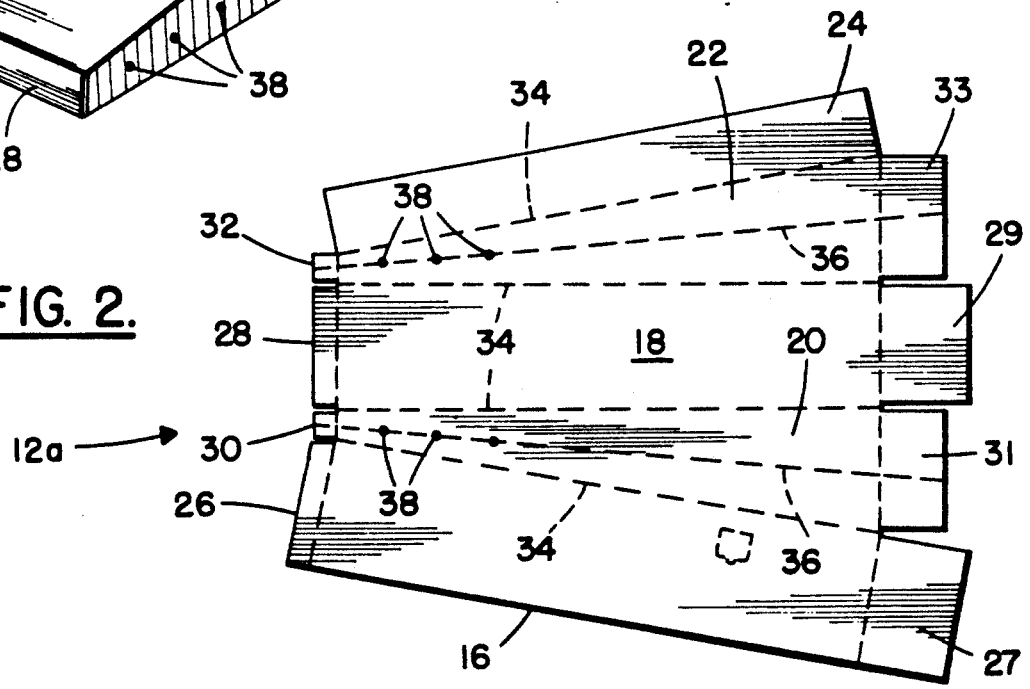
FIG. 2 is a plan top view of the outer carton shown in FIG. 1 in its preassembled blank form.
Figure 3:
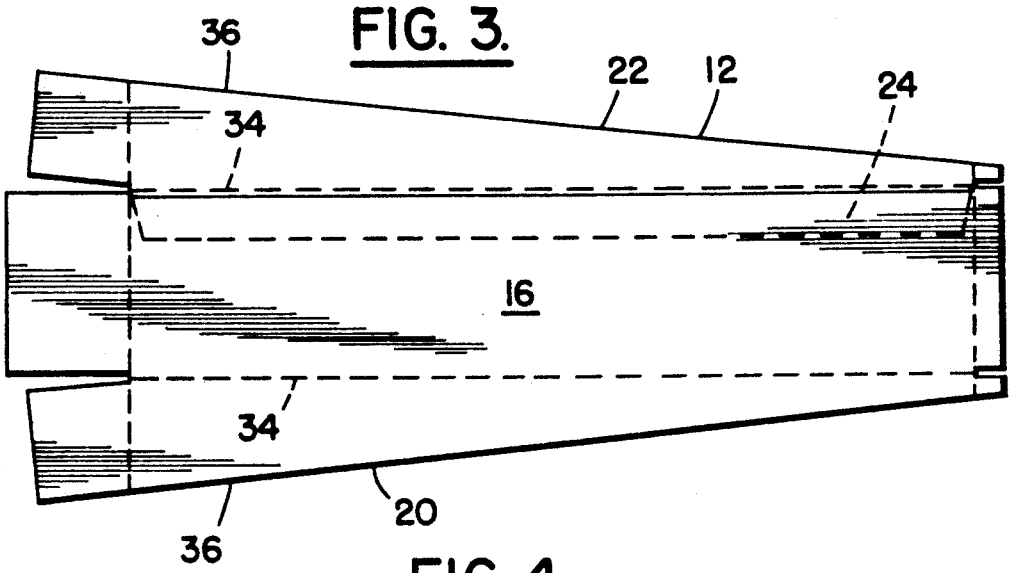
FIG. 3 is a plan top view of the outer carton shown in FIG. 1 in its collapsed configuration.

Referring also to FIG. 2, there is shown a plan top view of the outer carton as a precut and preprinted blank 12*a* prior to its wrapping and fastening to form the shape as shown in FIGS. 1 and 3. The outer carton 12, in the embodiment shown, is generally comprised of corrugated cardboard and comprises a body with a first rectangular section 16, a second rectangular section 18, a first trapezoidal section 20, a second trapezoidal section 22, and a joint flap 24. Also in the embodiment shown, the outer carton 12 comprises a plurality of forward end flaps 26, 28, 30 and 32 and, a plurality of rearward end flaps 27, 29, 31 and 33. In the embodiment shown, the outer carton 12 comprises four first crease or fold lines 34 that help to at least partially define the first and second triangular sections 20 and 22. Also in the embodiment shown, the first and second trapezoidal sections 20 and 22 each comprise a second fold line 36 along their longitudinal length. The first and second types of fold lines 34 and 36 are generally formed by scoring, stamping, or otherwise forming the corrugated cardboard with a line of weakness. Suitable additional third fold lines are provided between the body 16–22 of the outer carton 12 and its forward and rearward end flaps 26–33. In the embodiment shown, the second fold lines 36 also comprise perforations 38 proximate the forward end of the outer carton 12. The perforations 38 need not be provided, but are preferable in the embodiment shown to locally weaken the cardboard at the forward end of the blank 12*a* to ensure that the carton can bend properly at the forward portion of the second fold lines due to the decreased spacing of the second fold lines 36 from the first fold lines 34 proximate the forward end. The width of the trapezoidal sections 20 and 22 at the forward end is small such that the sides of the carton 12 almost have a triangular shape. Thus, the small width requires the perfections to weaken the cardboard along the fold lines 36.

Figure 4:
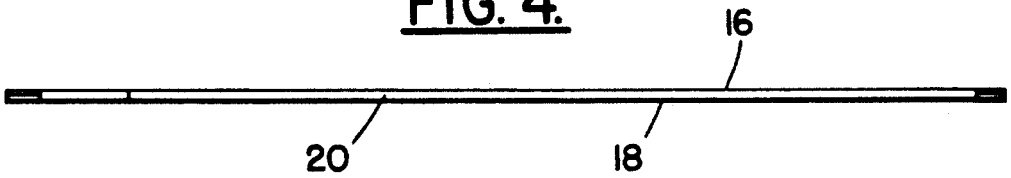
FIG. 4 is a plan side view of the carton shown in FIG. 3.

Referring also to FIGS. 3 and 4, the outer carton 12 is shown in its preloaded and partially preassembled flat configuration or profile that is used when the outer carton 12 is shipped from its initial fabrication site to a packaging or loading site for loading of articles or goods into the carton. Generally, in order to form the preassembled flat configuration, a sheet of corrugated cardboard is cut and preprinted with appropriate printed matter and graphics. The formation of the fold lines is also done by any suitable means to form the blank 12*a* shown in FIG. 2. The blank 12*a* is then bent along the second fold lines 36 and glue is applied between the joint flap 24 and first rectangular section 16 to fix the two sections together. However, any suitable type of fixation, including staples, can be used. In addition, the blank 12*a* can be suitably configured such that the joint flap 24 can be fixedly connected to any suitable section of the body of the outer carton. However, attachment of the first rectangular section 16 with the joint flap 24 extending from the second trapezoidal section 22 has been found to provide the best structural integrity for the carton 12 when it is in its wedge shaped configuration, the greatest amount of surface area for the glue to joining the two sections, and a symmetrical preassembled flat configuration as shown in FIG. 3 which is easier to handle, ship and store. In the embodiment shown, the flat configuration is symmetrical in two planes; the plane parallel to the rectangular sections 16 and 18, and the plane perpendicular to and longitudinally through the rectangular sections 16 and 18. As can be seen best in FIG. 3, the joint flap 24 is located inside the pre-assembled flat carton configuration under the first rectangular section 16. This allows for the entire exterior surface of the first rectangular section 16 to have printed matter and graphics thereon without obscuring the view by the presence of the joint flap 24 over the first rectangular section 16. In addition, the relatively small gap between the second trapezoidal section 22 and the first rectangular section 16 (equal to about the thickness of the cardboard) provides a substantially continuous looking view of graphics on the exterior of the carton at the joint to provide a substantially uninterrupted visual appearance. As can be seen in this preassembled flat configuration, the cardboard at the two second fold lines 36 is bent with the cardboard at the four first fold lines 34 being substantially straight with a substantially mirror-like or symmetrical flat profile. With the precut and preprinted blank 12*a* bent and glued into the partially preassembled flat configuration shown in FIGS. 3 and 4, the carton 12 generally has a closed structural loop formed by the body sections of the carton. This closed structural loop, although substantially flat in the partially preassembled flat configuration shown, can be expanded to the wedge shape shown in FIG. 1 by straighening the two trapezoidal sections 20 and 22 at their second fold lines 36 and bending the cardboard at the first fold lines 34. However, once the precut and preprinted blank 12*a* is folded and glued into the partially preassembled flat configuration shown in FIGS. 3 and 4, the carton can be shipped to the goods loading site.

One of the features of the present invention is the delivery of the partially preassembled flat configuration empty carton, as shown in FIGS. 3 and 4, to the loading site. The reason for this is that the partially preassembled flat configuration empty carton can then be relatively easily shipped to and stored at a loading station. More importantly, the delivery of the partially preassembled carton to the loading site significantly reduces the amount of manual labor needed to properly load the carton with the goods as will be further described below.

Another feature of the present invention is that the carton 12 lends itself to automated machine partial preassembly as described above. The printing, cutting, wrapping and gluing of the cardboard to form the partially preassembled flat configured empty carton 12 can all take place with the use of a single machine prior to the loading operation of goods into the carton. As described above, due to the irregular shape of the wedge shaped carton, in the past, the goods had to be placed on a blank carton at a loading site and then the carton was wrapped and glued into its final shape. The above described outer carton 12 overcomes this disadvantage in the prior art and thus allows for both automated partial preassembly of the flat configured carton and, easier loading of the objects into the carton at the loading site.

Figure 5:
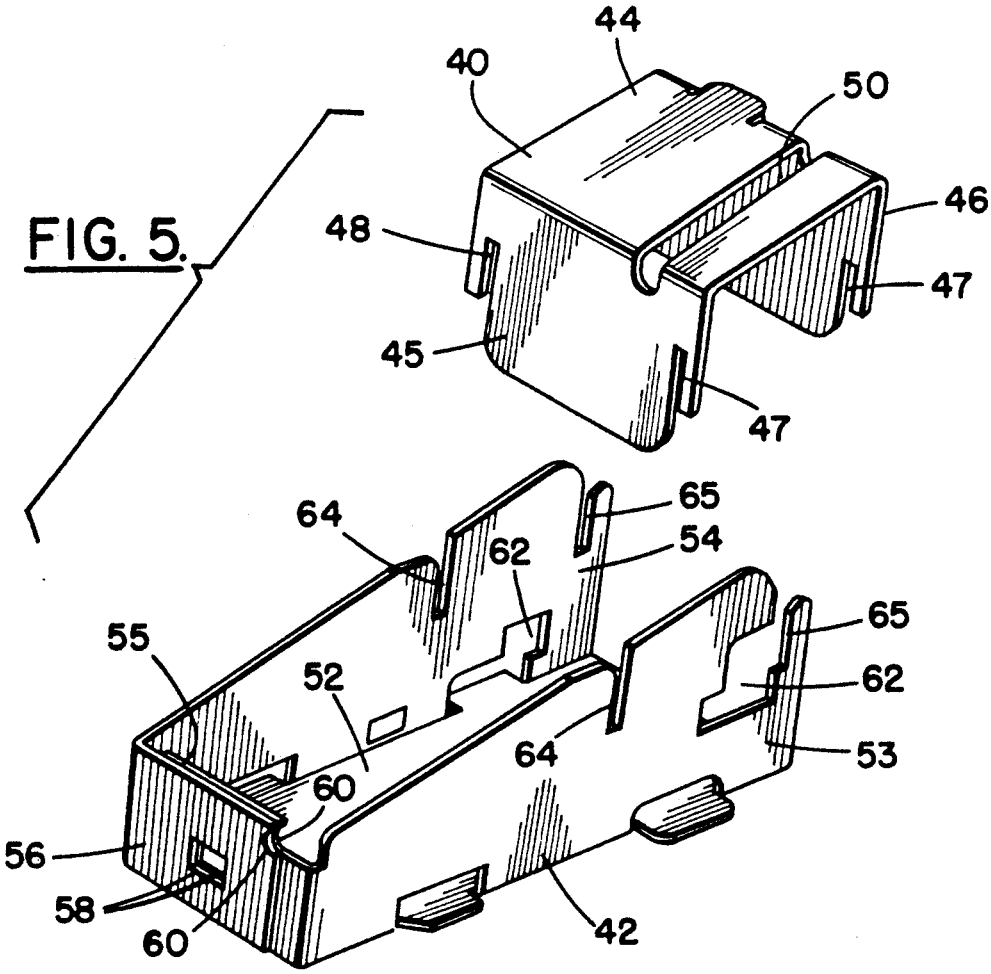
FIG. 5 is an exploded perspective view of the insert shown in FIG. 1.
Figure 6:
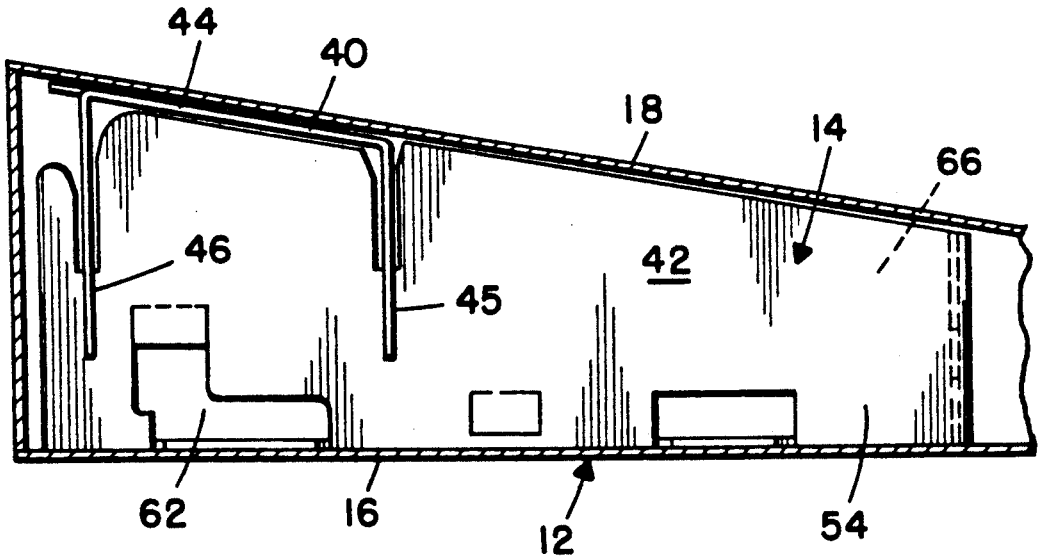
FIG. 6 is a partial schematic side view of the assembly shown in FIG. 1 with the insert inside the outer carton.

Referring now to FIGS. 1, 5 and 6, the stiffening insert 14 will be further described. In the embodiment shown, the insert 14 is comprised of two members; a top member 40 and a bottom member 42. However, in alternate embodiments of the invention, the insert 14 may be comprised of only one member or, more than two members. In the embodiment shown, both members 40 and 42 are comprised of cardboard that is cut and bent at fold lines of weakness to form the shapes as shown. The top member 40 has a top section 44 and two downwardly extending sides 45 and 46. Located in the sides 45 and 46 are slots 47 and 48 for cooperatingly mounting the top 40 to the bottom 42. The top 40 also has a top groove 50 for locating and holding an object to be packaged such as a rod or pole. The bottom member 42 has a bottom 52, two sides 53 and 54, and two front flaps 55 and 56. The front flaps 55 and 56 each have a hole 58 and groove 60 for locating and holding objects. The sides 53 and 54 also have holes 62 for holding and locating goods as well as slots 64 and 65 for cooperating with the slots 47 and 48 of the top 40.

Referring also to FIG. 6, there is shown a schematic partial cross-sectional view of the insert 14 inside the outer carton 12. The method of packaging the goods inside the outer carton can generally be performed as follows. A loader can take an insert bottom member 42 and bend up the sides 53 and 54. Goods, such as an engine for a string trimmer, can be placed on the bottom member bottom 52 between slots 64 and 65 with portions of the goods located in the holes 62. The top member 40 can then be located over the goods with slots 64, 65, 47 and 48 cooperating to lock the top member over the bottom member. As can be seen in FIGS. 1 and 6, the top edges of the bottom member sides 53 and 54 are sloped to substantially match the slope of the outer carton 12. The top surface 44 of the top member 40, when mounted to the bottom member 42 is also orientated at a slope to match the slope of the outer carton 12. Other goods such as a grass trimmer handle and grass trimmer grass deflector (not shown) can be located in the bottom member 42 in an area 66 in front of the top member 40. The front flaps 55 and 56 can be closed with a portion of an article passing through the holes 58 to hold the flaps together and hold the article to bottom member 42. Additional locking means (not shown) for the flaps 55 and 56 may also be provided. In the embodiment shown, a rod (not shown) such as a grass trimmer drive shaft housing can be located in top member groove 50 and front flap grooves 60 and extend in front of the front flaps 55 and 56. Next, in order to load the insert 14 and goods into the outer carton 12, a loader takes a partially preassembled carton 12, as shown in FIG. 3, and expands the carton by moving the rectangular sections apart. In a preferred method, the operator prestresses the outer carton 12 by pushing the trapezoidal side sections 20 and 22 in towards each other, effectively reversing the bend at the second fold lines. Thus, the outer carton 12 will not automatically bend back to its flat configuration and a substantial wedge shape is formed. The loader can then load the goods and insert 14 into the rear end of the outer carton 12. As the insert 14 is inserted, it comes into contact with and bears against the two rectangular sections 16 and 18 and effectively wedges the two rectangular sections 16 and 18 apart. This is generally accomplished by the bottom 52 of the bottom member 42 bearing against the first rectangular section 16 and the top surface 44 of the top member 40 and the top edges of the bottom member sides 53 and 54 bearing against the second rectangular section 18. As the two rectangular sections 16 and 18 are spaced apart, the two trapezoidal sections 20 and 22 are straightened with any distortion by second fold lines 36 virtually eliminated.

One of the unique features of the present invention resides in the location and amount of area of bearing between the insert 14 and outer carton 12. The insert 14 is suitably sized to extend over half the length of the outer carton 12 when inserted. However, any suitable length may be provided. The area of contact includes the entire bottom member bottom 52, the relatively large surface of the top member 40, and the top edges of the bottom member sides 53 and 54. This is obviously a relatively large amount of area to support the outer carton 12. In addition, the top edges of the bottom member sides 53 and 54 are located proximate the fold lines 34 to prevent distortion or bending of the second rectangular section 18 due to bearing by the insert. Once the goods and the insert are positioned in the now wedge shaped outer carton, the forward and rearward end flaps 26–33 can be closed and fixed by staples or glue or tape. The packaging is thus complete and the carton and insert assembly 10 with goods can be grouped or packaged with other packages for shipment to a customer or retainer.

Let it be understood that the the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A packaging assembly for packaging and transporting an article, the assembly comprising:

a collapsible outer carton being comprised of a unitary sheet of cardboard with a first rectangular section, a second rectangular section, a first trapezoidal section, a second trapezoidal section, and a joint flap, said first trapezoidal section being located between said first and second rectangular sections opposite said second trapezoidal section being located between said first and second rectangular sections opposite said first trapezoidal section with first fold lines at junctions between said rectangular and trapezoidal sections, said first and second trapezoidal sections having second fold lines longitudinally therealong and said joint flap being fixed to said first rectangular section such that said outer carton can have at least two configurations, a first configuration with said outer carton bent at said second fold lines such that said outer carton has a substantially flat profile and, a second configuration with said outer carton bent at said first fold lines such that said outer carton has a substantially wedge shaped profile; and a stiffening insert having a general wedge shaped profile, said insert being located inside said outer carton and suitably sized and shaped to substantially prevent said outer carton from collapsing along said second fold lines to thereby retain said outer carton wedge shaped profile during shipment of the assembly and an article packaged therein, said insert being comprised of at least two pieces of interlocked cardboard that form at least one chamber therein.

2. An assembly as in claim 1 wherein said outer carton comprises forward and rearward end flaps.

3. An assembly as in claim 1 wherein said joint flap is glued to said first rectangular section.

4. An assembly as in claim 3 wherein said carton has a central chamber with said joint flap being located inside said chamber.

5. An assembly as in claim 1 wherein said outer carton has printed matter thereon that is relatively continuous between at least one rectangular section and one trapezoidal section.

6. An assembly as in claim 1 wherein said second fold lines comprise a plurality of perforations.

7. An assembly as in claim 1 wherein said outer carton is comprised of corrugated cardboard.

8. An assembly as in claim 7 wherein said fold lines are comprised of compressed sections of said corrugated cardboard.

9. An assembly as in claim 1 wherein said insert is suitably shaped to at least partially hold a portion of an article.

10. An assembly as in claim 1 wherein said two pieces are formed from a single sheet of cardboard that is cut and folded along fold lines to form said insert.

11. A package assembly for an article comprising:

a collapsible outer carton having means for forming two shapes, a first relatively flat shape and a second relatively wedge shape; and a stiffening insert having a general wedge shape, said insert being comprised of at least two pieces of interlocked cardboard that are formed from a single sheet of cardboard that is cut and folded along fold lines to form said insert, said insert being suitably sized and shaped and located inside said outer carton to prevent said outer carton from collapsing to its relatively flat shape such that said outer carton is substantially prevented from collapsing after an article and said insert are inserted thereinto and, prior to insertion of said insert, said outer carton can be collapsed to said relatively flat shape for compact storage.

12. An assembly as in claim 11 wherein said carton is comprised of a single sheet of cardboard with two rectangular sections and two trapezoidal sections.

13. An assembly as in claim 12 wherein said insert wedges said rectangular sections apart to keep said trapezoidal sections substantially straight.

* * * * *